US005609442A

United States Patent [19]

Horton

[11] Patent Number: 5,609,442

[45] Date of Patent: Mar. 11, 1997

[54] OFFSHORE APPARATUS AND METHOD FOR OIL OPERATIONS

[75] Inventor: Edward E. Horton, Rancho Palos Verdes, Calif.

[73] Assignee: Deep Oil Technology, Inc., Irvine, Calif.

[21] Appl. No.: 513,288

[22] Filed: Aug. 10, 1995

[51] Int. Cl.[6] ..... E02B 17/00

[52] U.S. Cl. ..... 405/205; 405/196; 405/204

[58] Field of Search ..... 405/204–208, 405/196, 200; 166/360, 350, 359, 367

[56] References Cited

U.S. PATENT DOCUMENTS

| | | | |
|---|---|---|---|
| 3,091,089 | 5/1963 | Gellerstad | 405/206 |
| 3,797,256 | 3/1974 | Gibion | 405/196 |
| 4,117,691 | 10/1978 | Spray | 405/205 |
| 4,158,516 | 6/1979 | Noblanc et al. | 405/200 X |
| 4,181,453 | 1/1980 | Vache | 405/205 X |
| 4,217,848 | 8/1980 | Meyer-Haake | 405/196 X |
| 4,266,887 | 5/1981 | Corder | 405/208 X |
| 4,451,174 | 5/1984 | Wetmore | 405/196 |
| 4,627,767 | 12/1986 | Field et al. | 405/208 X |
| 4,702,321 | 10/1987 | Horton . | |

FOREIGN PATENT DOCUMENTS 991247 5/1965 United Kingdom .

2003964 3/1979 United Kingdom .

*Primary Examiner*—Dennis L. Taylor

*Attorney, Agent, or Firm*—Poms, Smith, Lande & Rose Professional Corporation

[57] ABSTRACT

An offshore apparatus and method for oil operations at a deep water well site wherein a lower hull includes a pontoon portion providing a large water plane area and also includes an upwardly facing body opening, an upper hull is fabricated within said body opening in fully telescoped relation therewith, said upper hull and lower hull being vertically relatively movable, and a deck carried by the upper hull. The pontoon portion has suffient displacement to support the apparatus in towing draft mode. The lower hull and upper hull include floodable compartments for selective ballasting and deballasting to raise and lower the hulls relative to each other in order to submerge the apparatus under stable conditions and to change the draft from towing mode to operating mode in which the hulls are in extended nontelescopic relation at a selected draft. Support lines interconnecting the lower hull and deck are selectively tensioned to aid in the transition from towing draft to operating draft. Interengagable stop shoulders are provided between the upper and lower hulls and at operating draft may be secured to assist in maintaining the extended nontelescopic relation thereof. Guides for relative vertical motion of the upper and lower hulls are provided at the outer surface of the upper hull and the stop shoulder of the lower hull. The support lines may later serve as anchor lines.

17 Claims, 10 Drawing Sheets

OFFSHORE APPARATUS AND METHOD FOR OIL OPERATIONS

BACKGROUND OF THE INVENTION

This invention relates to an offshore apparatus for drilling, production, and storage of oil at a deep water well site and to a method of fabrication, transport in towing mode and draft, and of a method of transition from towing draft to operating draft. The construction and method involve upper and lower hulls arranged in telescopic relation for towing and in vertically extended nontelescopic relation for operations at a well site.

Prior proposed floating vessels for drilling, production, and storage of oil at sea have included semisubmersibles, spars or caissons of great length, and semispars. A deep draft spar of great length is shown and described in my U.S. Pat. No. 4,702,321. Shallow draft stepped spars such as FLIP and the Brent spar, as well as the deep draft spar,require transit to a well site in horizontal position and then are ballasted to a vertical position to an operating draft. The Flip spar is a floating instrument platform including a long (about 350 feet) cylinder necked down at the water line. The Brent spar is a long (about 300 feet) cylindrical spar for storing oil. In some instances, decks are installed in upright position because the size of the deck precludes horizontal towing. Other step spars have been designed for towing in vertical position. One such step spar was constructed of concrete using slip forms in vertical arrangement and towed in vertical position. Towing in vertical position resulted in designs having restricted transit routes, limited draft, such as 120 feet, and presented problems of stability during towing. Usually a single hull construction was involved.

Prior proposed offshore structures have included floatable barges supporting upstanding columns and means including decks movable vertically with respect thereto into position above the sea surface. In many instances the floatable barge was sunk to the sea floor and served as a base. Heave motion of the structure at the well site was not a design consideration.

British specification 991,247 published May 5, 1965 shows a structure adaptable for semisubmersible operation in which a floatable bottom grid supports columns along which a deck is vertically movable, the columns being laterally reinforced by bracing.

UK Patent Application GB 2,003,964 shows a method of mounting a deck on a marine structure comprising a submerged caisson with an upstanding tower over which the deck may be floated, the caisson being then raised to move the tower relative to the deck, and the deck then secured to the tower.

Such prior proposed structures did not contemplate a spar construction having a deep draft in operating position to achieve low heave motion and a shallow draft for stable transit to a well site.

SUMMARY OF INVENTION

The present invention contemplates a deep draft stepped spar embodying relatively movable telescoped hull means and a novel method of construction and of installation at a sea well site. The spar apparatus generally comprises a lower hull means including a pontoon bottom portion of selected displacement and water plane area during transit to support an upper hull means and a deck on top of the upper hull means. The lower hull means includes a body opening for housing the upper hull means which is independently vertically movable with respect to the lower hull. The upper and lower hull means include compartments for selective flooding and deballasting to relatively vertically position the hull means as required by the operational conditions:from placement of the deck on top of the upper hull means, by relative positioning of the hulls during towing to a well site, during transition from telescoped relation to extended non-telescoped relation, and finally to a selected deep draft at the well site where low or minimal heave motion of the apparatus is achieved. Relative vertical movement of the upper and lower hull means is further controlled by line support means interconnecting the deck and pontoon portion; the line support means later may serve as anchor lines for connection to sea anchors.

The primary object of this invention is to provide a novel offshore spar-type apparatus having upper and lower hulls in telescopic relation and a novel method of construction, transport, and transition from towing draft mode to operational mode.

An object of the invention is to provide such an apparatus which is stable in towing draft mode and which in operating mode provides a deep draft with minimal motion in heavy seas.

Another object of the invention is to provide a novel method of fabrication of the upper and lower hulls with the upper hull constructed within a body opening being formed in the lower hull and in telescopic relation, both hulls being constructed in normal building upright condition, and movable to a well site without change from such telescopic relation. The novel method also includes novel steps in the transition of the hulls from telescopic to non-telescopic relation and from towing draft to operating draft.

Another object of the invention is to provide selected water plane areas and variable ballast compartments in both hulls whereby the apparatus is stable in towing, in operations and in transition steps from towing draft to operational draft.

A further object of the invention is to interconnect the deck with the lower hull by selectively tensioned support lines during such transition steps.

A further object of the invention is to provide abutment shoulders on the top of the lower hull and at the bottom of the upper hull for limiting extended relation of the hulls, the shoulders being adapted to be secured in abutting relation to secure the hulls together to act as a unit in deep draft operating mode.

Still another object of the invention is to provide guide means on the upper hull and lower hull to prevent relative rotation of the hulls during such relative vertical movement.

A still further object of the invention is to provide another embodiment of the lower hull means in which a plurality of circularly spaced columns extend above the pontoon portion and are connected at their tops by an annular top wall, the columns and top wall providing a body opening for the upper hull means.

The invention contemplates flooding selected compartments in the pontoon portion and columns of the upper hull to maintain stability during various transitional stages of the upper and lower hulls.

The invention further contemplates that the second embodiment of the lower hull means provide vertical windows between the columns whereby in operating deep draft mode the effect of subsea ocean currents are reduced and stability enhanced.

Other objects and advantages of this invention will be readily apparent from the following description of exemplary embodiments of this invention and the drawings that follow.

IN THE DRAWINGS

Figure 6:
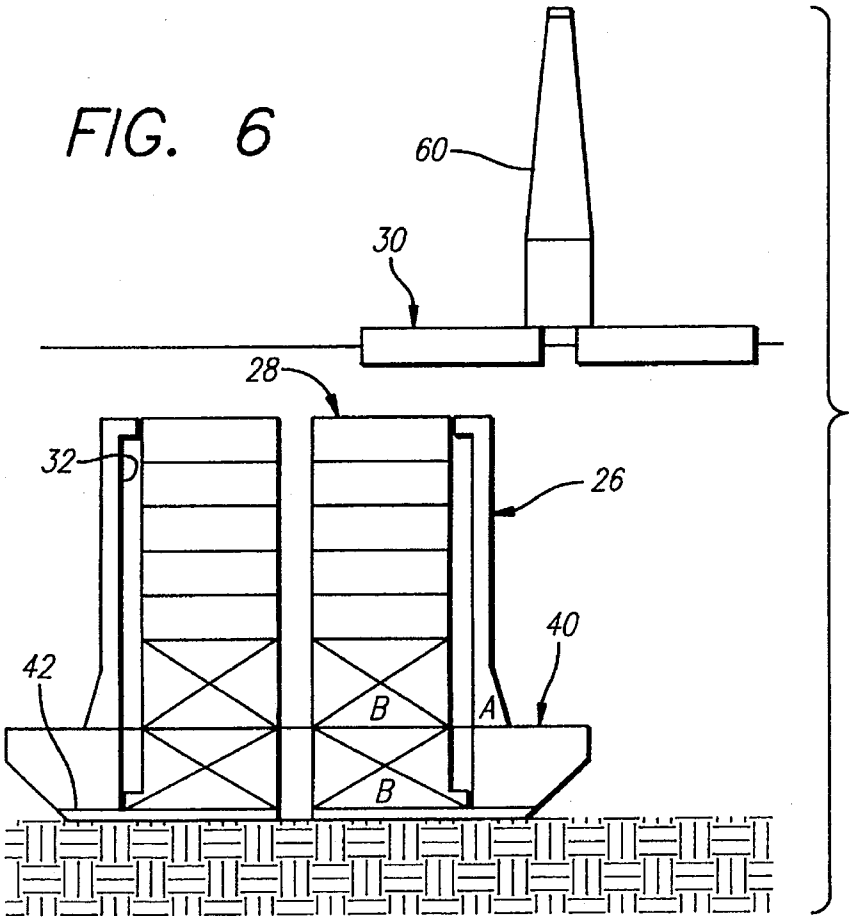

FIG. 6 schematically shows the installation of a deck on the assembled upper and lower hull means by floating the deck over a submerged assembled upper and lower hull means.

Figure 7:
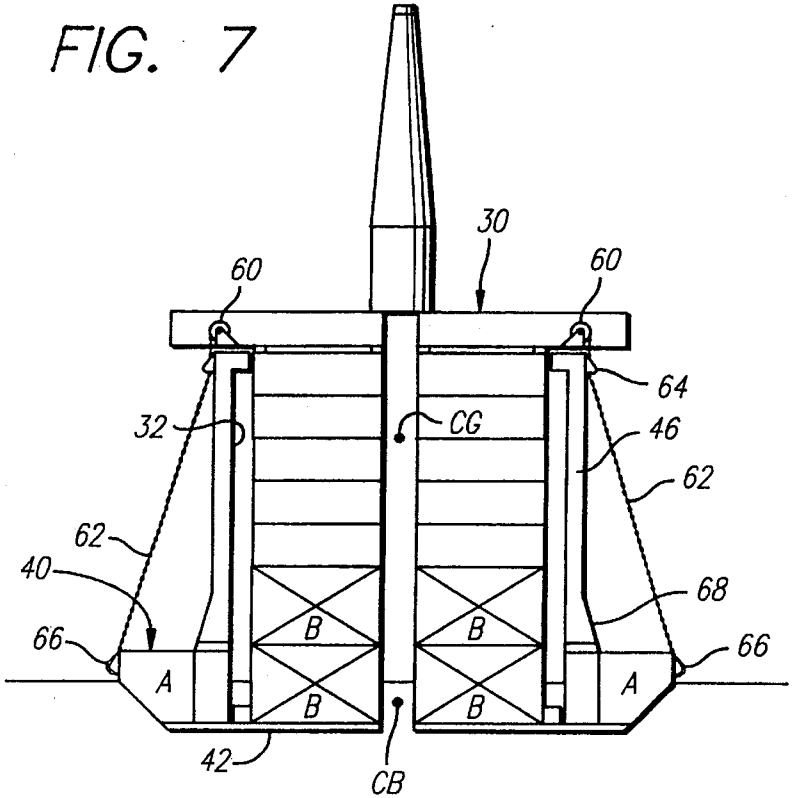

FIG. 7 shows the apparatus with the deck attached and the upper and lower hull means in towing mode for transport to a well site.

Figure 8:
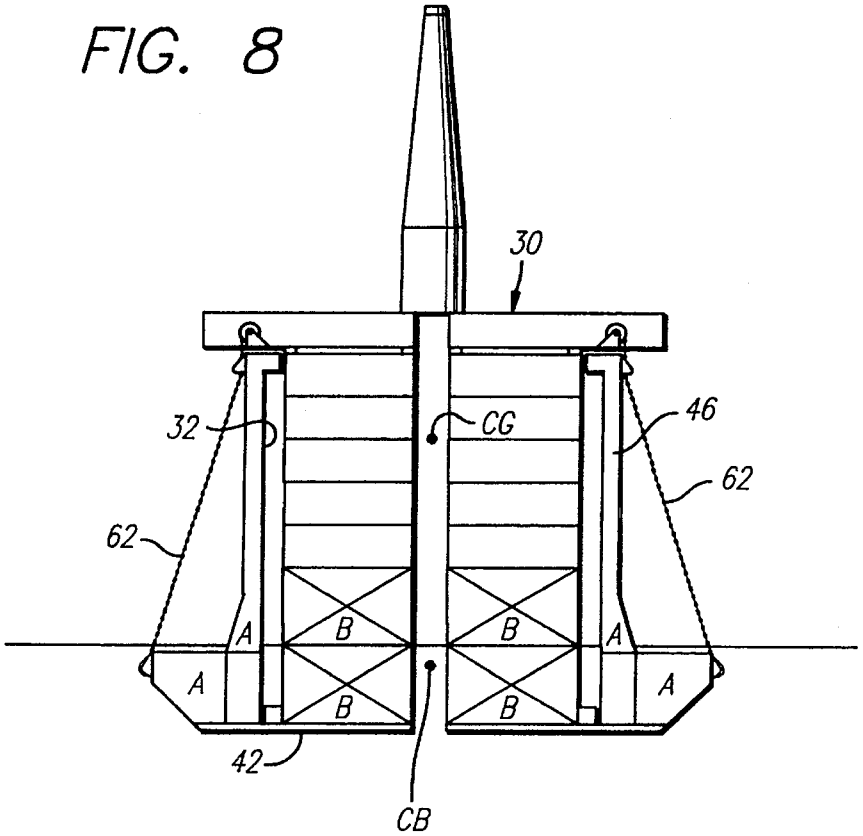

FIG. 8 shows a first step in installation of the apparatus at a well site.

Figure 9:
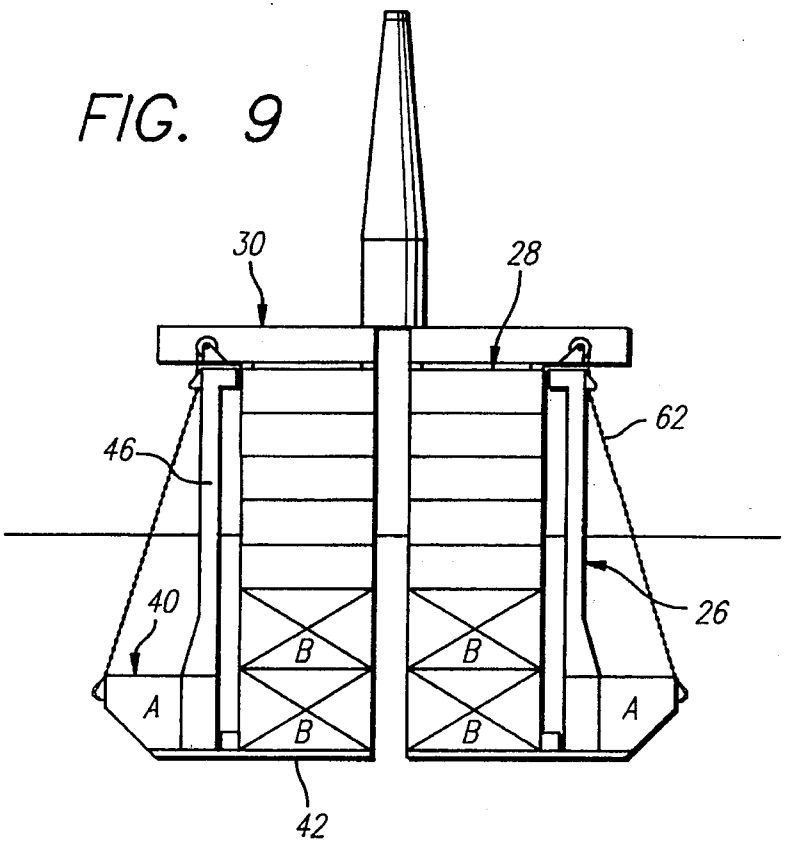

FIG. 9 shows a second step in such installation.

Figure 10:
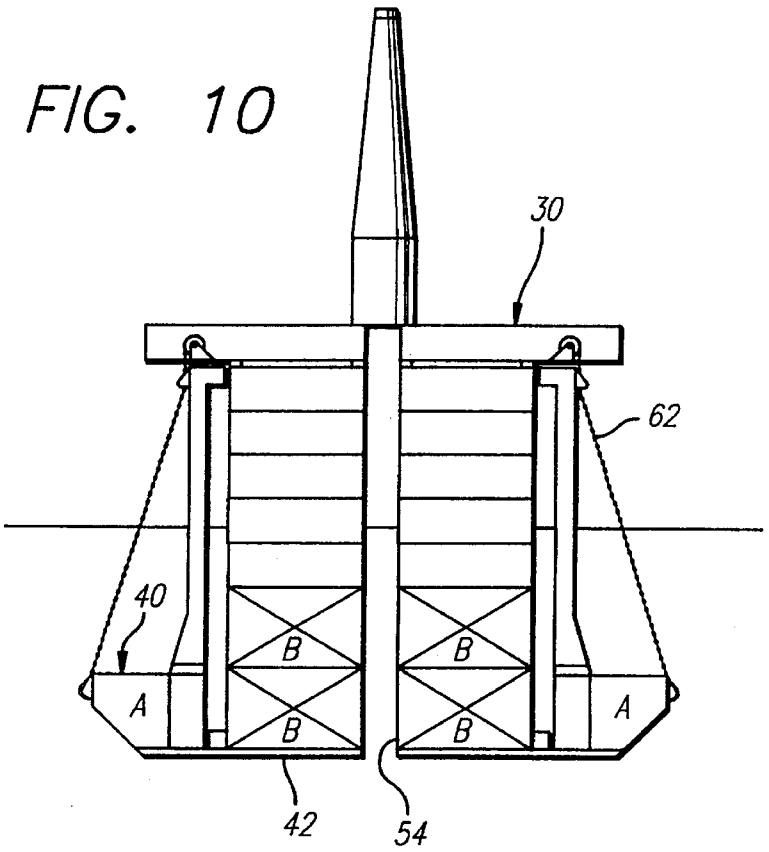

FIG. 10 shows a third step in such installation.

Figure 11:
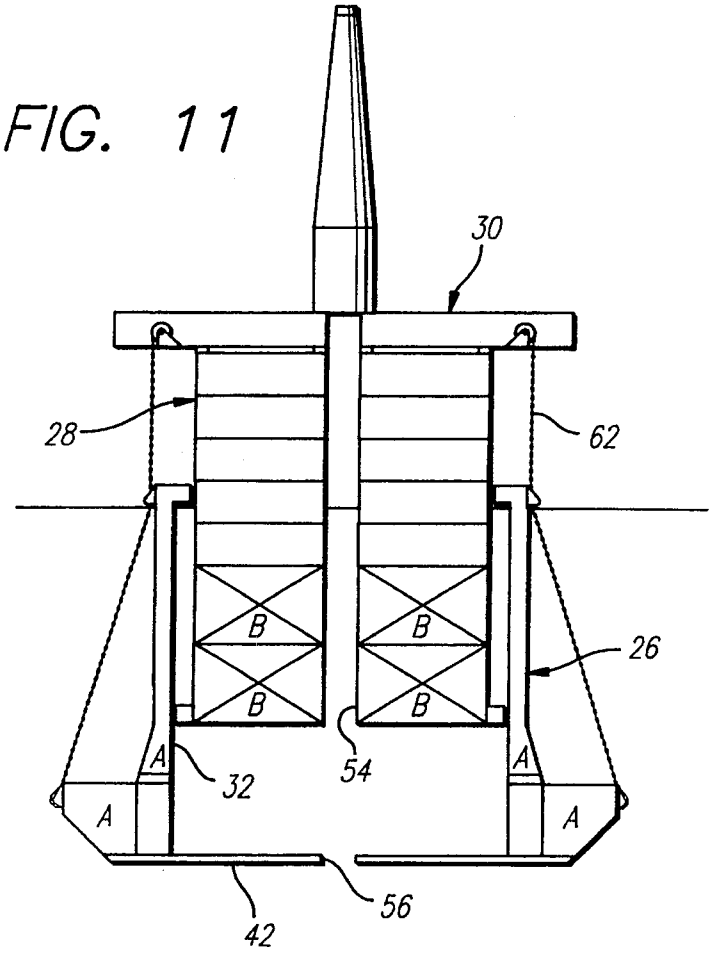

FIG. 11 shows a fourth step in such installation in which the upper and lower hulls are beginning to separate.

Figure 12:
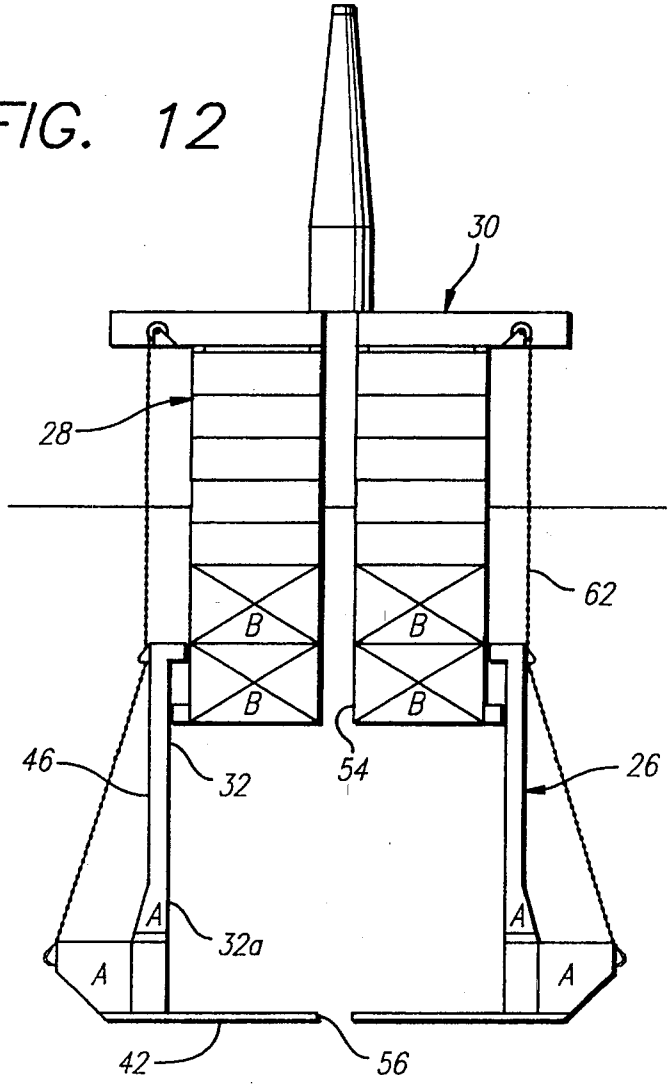

FIG. 12 shows a fifth step in such installation.

Figure 13:
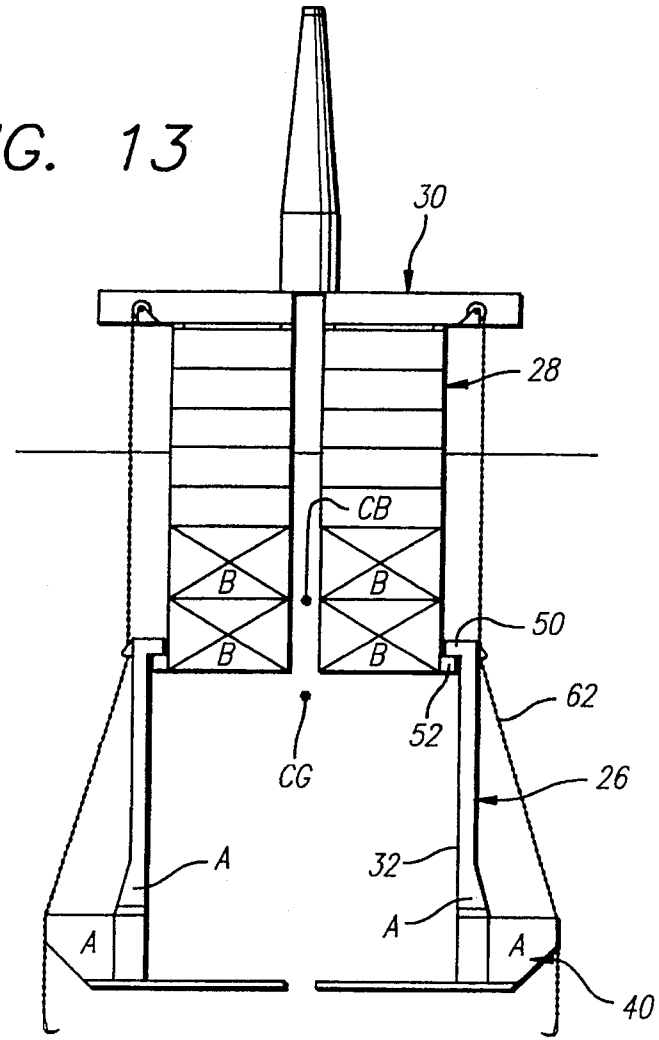

FIG. 13 shows a sixth step in such installation.

Figure 14:
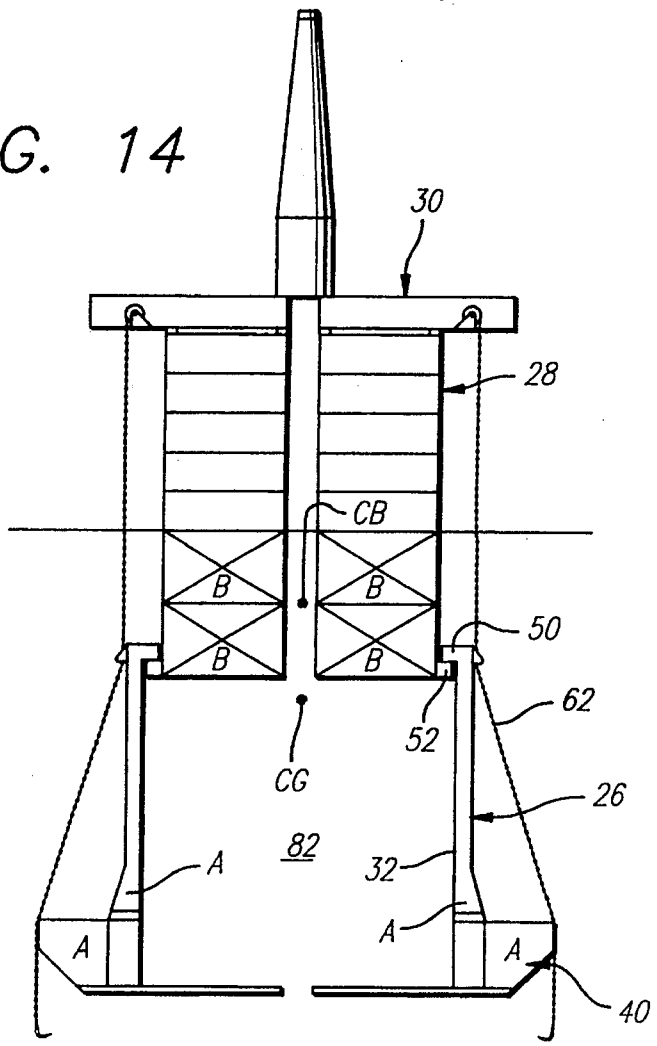

FIG. 14 shows a seventh step in such installation.

Figure 15:
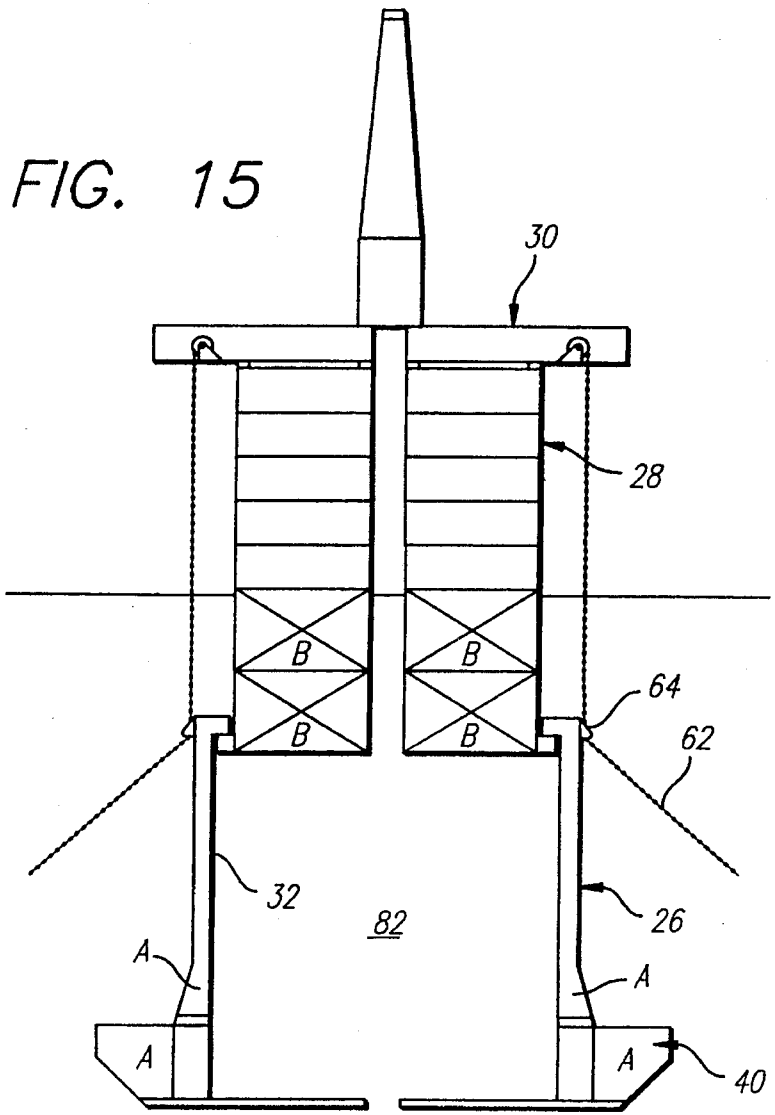

FIG. 15 shows an eighth step in such installation.

Figure 16:
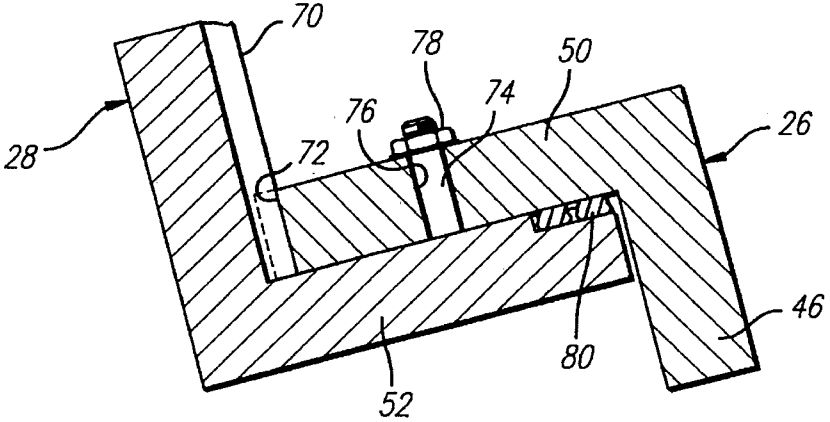

FIG. 16 shows an enlarged fragmentary sectional view showing stop and seal means between the upper and lower hull means in operational relation.

Figure 17:
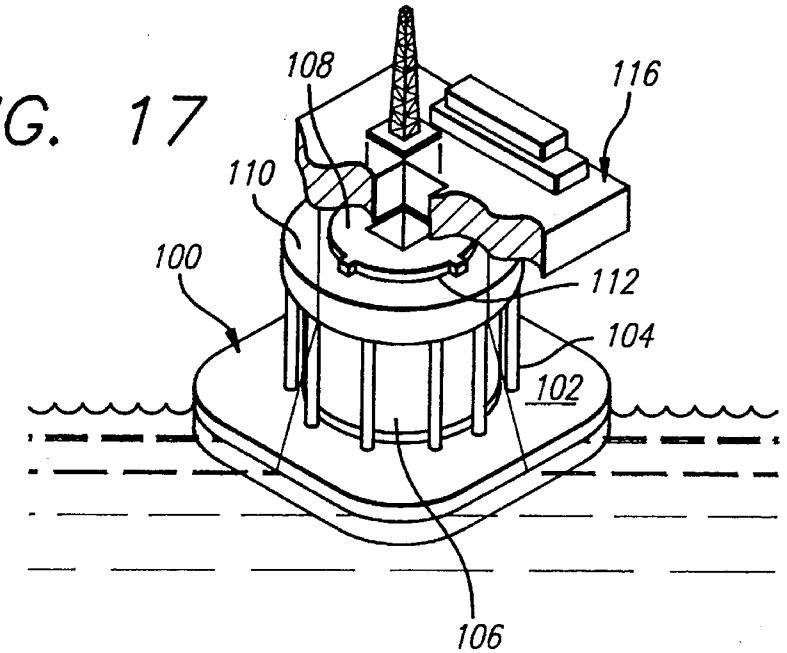

FIG. 17 shows a another embodiment of this invention, in isometric, in which the lower hull means includes vertical columns in spaced relation.

Figure 18:
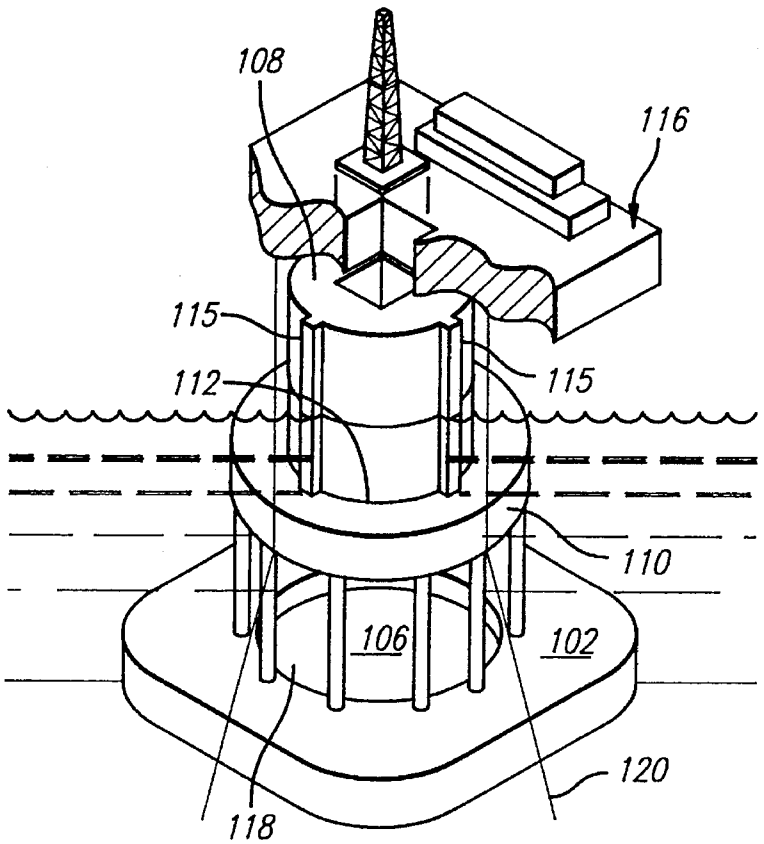

FIG. 18 is an isometric view showing the embodiment of FIG. 17 in operating position.

Figure 19:
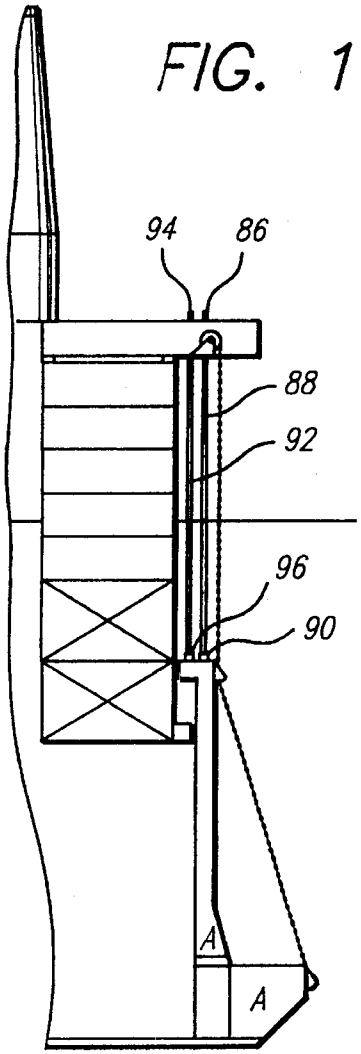

FIG. 19 schematically shows a vertical portion of the upper and lower hulls in the position shown in FIG. 12 with control lines to flood, vent, and air valves in the lower hull.

Figure 20:
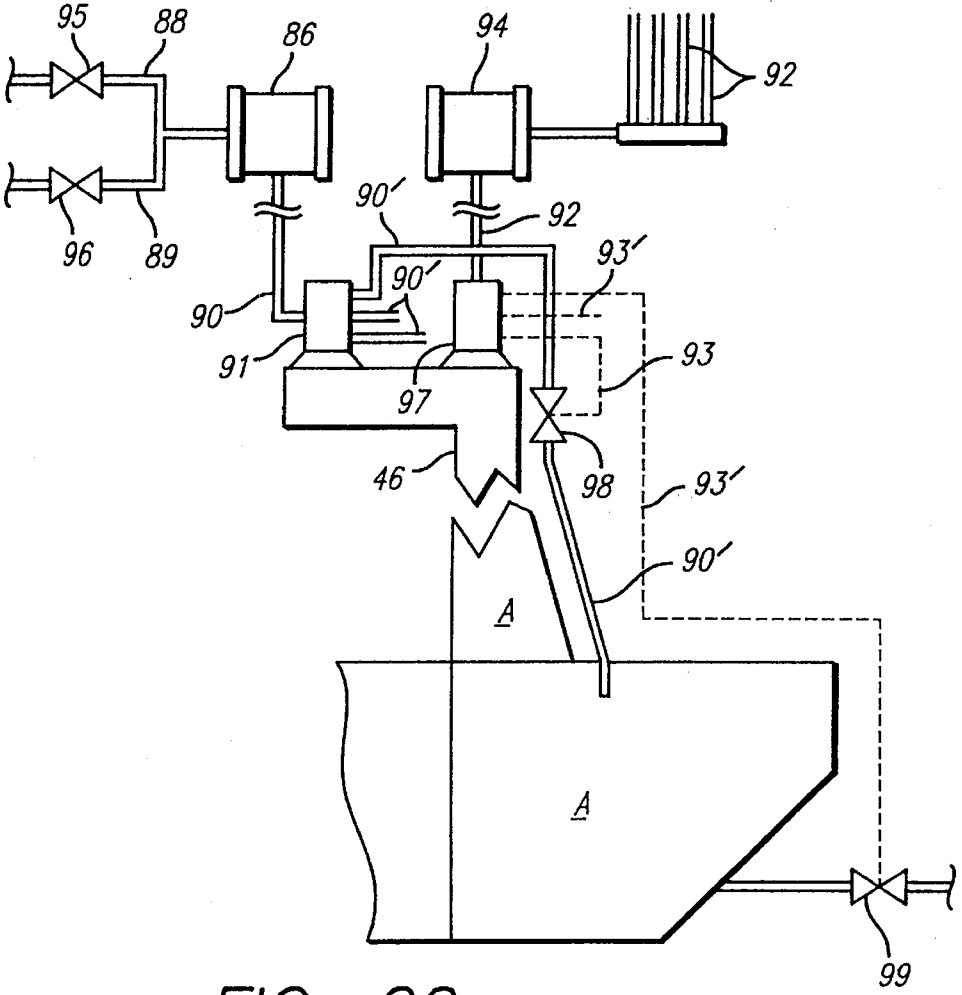

FIG. 20 is a fragmentary schematic drawing showing a compressed air operating system for controlling the flooding and deflooding of variable ballast tanks in the lower hull.

DETAILED DESCRIPTION

Figure 1:
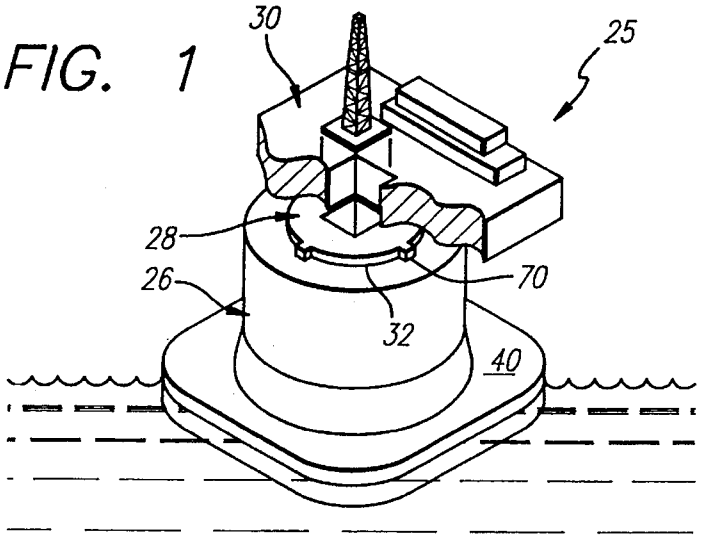
FIG. 1 is an isometric view of an apparatus embodying this invention in transport mode with the deck fragmentarily shown and with the upper hull means and lower hull means in telescopic relation.

In FIG. 1 a unique floating apparatus or vessel embodying this invention is shown in isometric and in towing draft mode, the apparatus being generally indicated at 25. Apparatus 25 comprises a lower hull means 26, an upper hull means 28, and a deck means 30. The upper hull means 28 is telescopically received for vertical movement within a body opening 32 provided in the lower hull means 26 as best seen in FIGS. 5–15.

Figure 2:
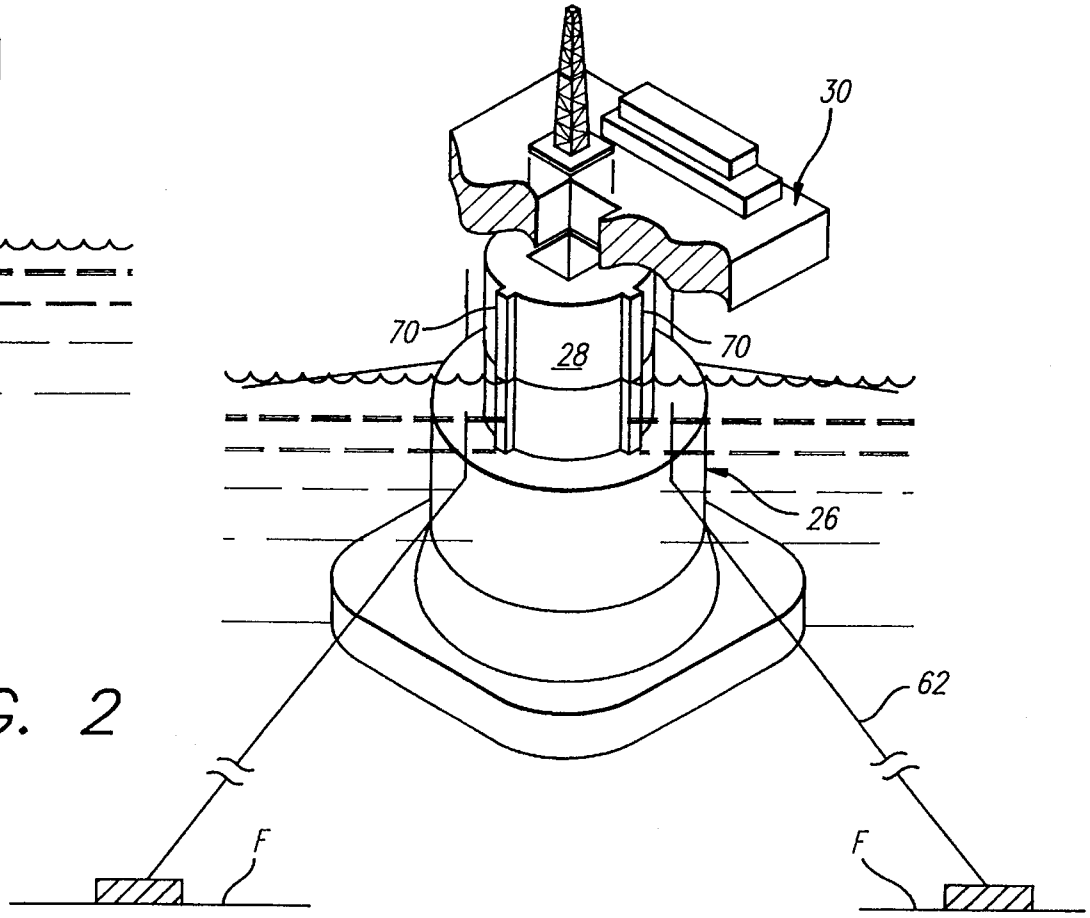
FIG. 2 is an isometric view of the apparatus of FIG. 1 with the upper and lower hull means in extended nontelescopic relation in operating mode at a selected well site.

In towing or transit draft mode, an exemplary draft of apparatus 25 shown in FIG. 1 may be about 25 feet and the height of the hull means and deck above the water surface may be exemplarily 150 feet. In operating mode as shown in FIG. 2 the draft may be exemplarily 225 feet. To further dimensionally identify the apparatus, the width of the pontoon portion 34 of the lower hull means may be 250 feet, the diameter of the upper hull means may be 150 feet, and the outer diameter of the lower hull means may be 180 feet. It will be understood that the dimensional configuration of the hull means may be varied and may be cylindrical, polygonal, or modified square.

Prior offshore drilling and production apparatus having such deep operating draft have often been fabricated by horizontal construction, towed to a well site in horizontal position, and at the well site rotated 90 degrees into operable vertical position. One of the advantages of the present invention is the fabrication of the apparatus 25 by vertical construction which will not require such 90 degree rotation as indicated in FIGS. 3–5.

Figure 3:
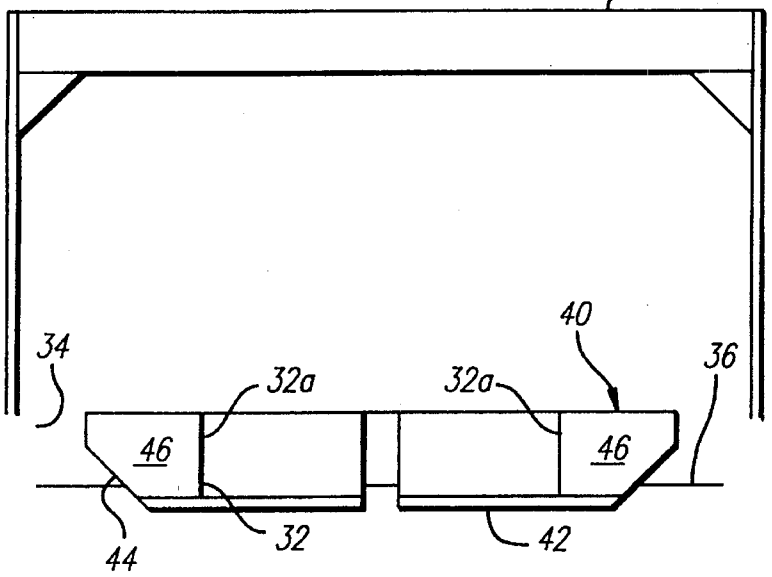
FIG. 3 is an elevational schematic view of the pontoon portion of the lower hull means illustrating a first phase in fabrication of the apparatus.

In FIG. 3 a dock 34 includes water 36 and an over head bridge crane 38 of known structure. The lower hull pontoon portion 40 may be of modified polygonal shape as shown in FIG. 1 and provided with a bottom recess **32*a*, forming the lowermost part of the body opening 32 of the lower hull means. A bottom wall 42 and side pontoon walls 44 form with the walls of recess 32*a* floodable tanks or compartments 46 in pontoon portion 40. The displacement of the lower pontoon portion 40 is sufficient to support the entire apparatus, upper and lower hull means and deck, during construction and towing. The pontoon portion 40** during towing also provides a water plane moment of inertia for stability and sufficient freeboard to maintain necessary righting moments when rolling and pitching during transit.

Figure 4:
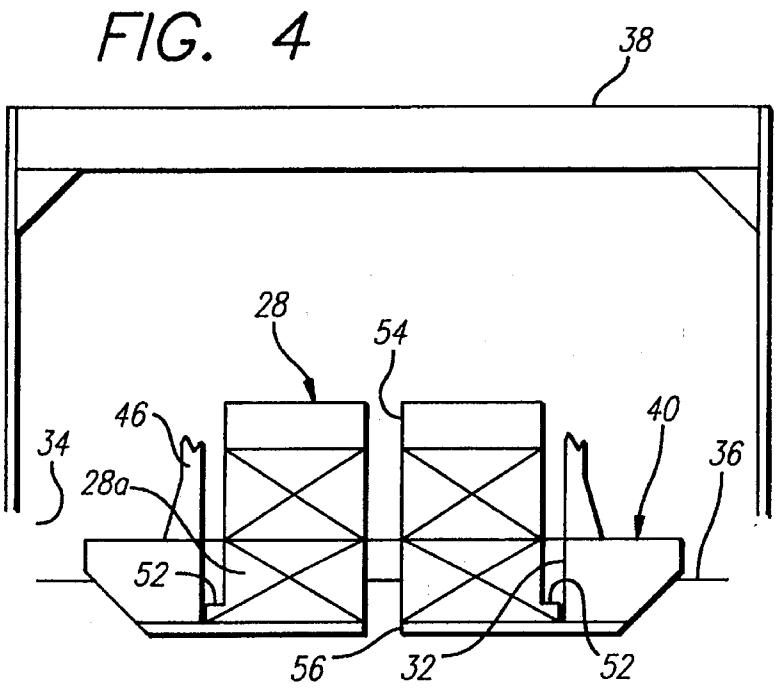
FIG. 4 shows a second phase in fabrication of the apparatus in which construction of the lower portion of the side walls of the lower hull has started, and construction of the upper hull has begun within the confines of the side walls of the lower portion.

FIG. 4 shows construction commencing of the side walls of the lower hull and the compartments of the upper hull within the body opening 32 of the lower hull. During such construction the pontoon portion 40 provides support therefor within the dock.

Figure 5:
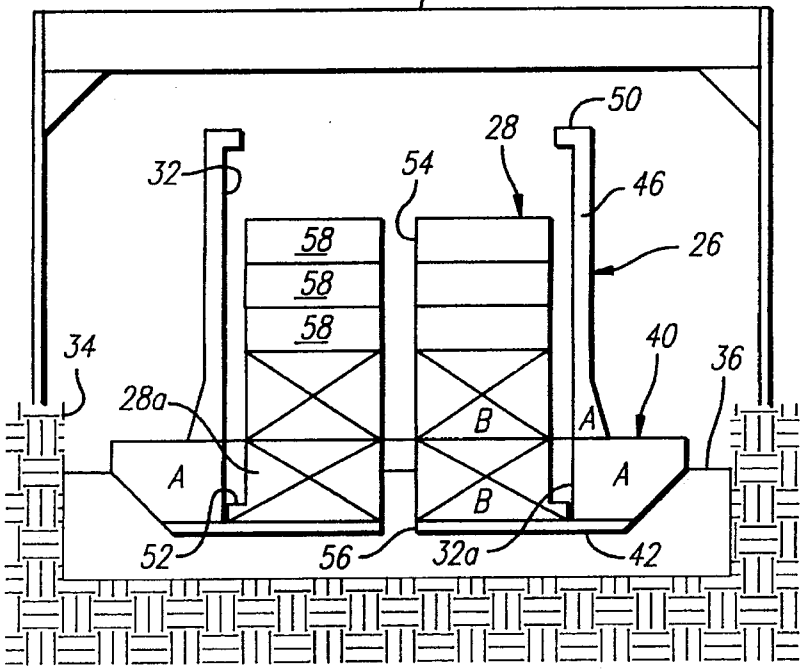
FIG. 5 shows a final phase in fabrication of the upper and lower hull means with the upper hull constructed within the body opening formed by the side walls of the lower hull.

FIG. 5 shows side walls 46 of the lower hull completed with an inboardly directed top shoulder 50 (also FIG. 16) for contact engagement with an outboardly directed shoulder 52 on the upper hull means as later described. The side walls 46 are compartmented and floodable.

Likewise the upper hull means 28 includes selectively floodable compartments at the lower part **28*a* of the upper hull which extends into recess 32*a* in the pontoon portion 40 in fully telescopic relation of the upper and lower hull means. As noted above outboardly extending shoulders 52 are provided at the bottom of the upper hull means. A central passageway 54 for drill pipe and risers (not shown) extends through the upper hull and through opening 56 in bottom wall 42 of the pontoon portion 40. When the upper hull is in such telescopic relation with the lower hull, the top of the upper hull is positioned at the top of the side walls of the lower hull, FIG. 7. Opening 56 permits sea water to flow into the central passageway 54 and the body opening 32 of the lower hull. Above the floodable compartments 28*a* in the upper hull may be provided suitable decks and space for equipment and the like as generally indicated at 58**.

The upper and lower hull means 26 and 28 are fabricated in assembled telescopic relation as indicated in FIG. 5 in dock 34 and beneath bridge crane 38. To assemble deck 30 with the hull means, the deck may be suitably constructed at another location with a drilling rig 60 and with other equipment thereon and floated to a location above a submerged hull means as shown in FIG. 6. The hull means 26 and 28 may be submerged by flooding the compartments in the lower hull means and the upper hull means until the top of the hull means are below the sea surface a selected distance. When the deck is positioned over the hull means flooded compartments in the upper hull may be deballasted to raise the upper hull into contact with and securement to the deck 30.

As shown in FIG. 7 the deck 30 may carry windlasses or winches 60 for lower hull support lines 62 which later serve as anchor lines and connect the apparatus to anchors on the sea floor F (see FIG. 1). Lines 62 pass through guide means 64 carried at the top of the side walls 46 of the lower hull and are connected at their ends to the periphery of the pontoon portion as at 66.

As mentioned above the pontoon portion 40 has a selected water plane area. The side walls 46 are provided with upwardly and inwardly tapering exterior wall surfaces 68 to provide selected water plane areas which diminish as the lower hull means is submerged from the position shown in FIG. 8 to that in FIG. 9. Stability of the apparatus during submergence is facilitated by providing selectively changing water plane areas.

Relative vertical movement of the upper hull means 28 within the body opening 32 with respect to the lower hull means 26 may be guided to control relative rotation therebetween by the provision of vertical rails or keys 70 (FIG. 2, 18). Keys 70 on the outer surface of the upper hull slidably engage keyways or recesses 72 in the inboard margin of shoulder 50 at the top of sidewalls 46 of the lower hull means.

An important feature of this invention is the method by which the upper and lower hull means are changed from towing draft relation to operating draft relation or from fully telescopic to nontelescopic relation. Referring to FIG. 7,towing draft mode, the apparatus is supported by pontoon 40 and all ballast tanks or compartments A and B deballasted or dry. Tanks A are in the lower hull means and tanks B are located in the upper hull means. The tanks are compartmented and are adapted to be selectively variably ballasted. The support lines 62 are snubbed tight.

To commence submergence of the apparatus, in FIG. 8, the lower ballast tanks B of the upper hull are flooded until the draft increases until the pontoon portion is completely under water. Such flooding of the upper hull lowers the center of gravity of the upper hull and the upper hull becomes stable in its own right. Under this condition the center of gravity of the apparatus is indicated generally at CG and the center of buoyancy at CB. Considering the displacement volume of the submerged pontoon portion,and the moment of inertia of the water plane at the beginning of the upward sloping surfaces 68 of the side walls 32, and the location of the centers of buoyancy and gravity, the metacentric height is positive and stability of the apparatus will be maintained.

In FIG. 9, the lowermost tanks A of the lower hull are flooded until the pontoon portion is nearly neutrally buoyant. The support lines 62 hold the lower hull against moving relative to the upper hull.

In FIG. 10, sea water is further flooded into the lower tanks A and B as the apparatus continues to submerge below the water surface and below operating draft.

In FIG. 11, sea water is flooded into tanks A in the walls 32 of the lower hull to keep the lower hull negatively buoyant as it is lowered from the position shown in FIG. 10. The support lines 62 are paid out at the same time to permit such lowering and to further control the change in vertical relationship of the upper and lower hull means.

In FIG. 12 negatively buoyant lower hull is further lowered by the support lines 62 to a position where it is fully submerged, the top of side walls 32 being well below the sea surface. No sea water has been added to the tanks A in the side walls 32.

In FIG. 13, the lower hull is further lowered by paying out the support lines 62 until shoulder 50 contacts shoulder 52 on the upper hull. The lower hull means is thus supported by the upper hull at shoulders 52,. Tanks A in the side walls 32 are then further flooded so that the upper and lower hull means are now in fully extended relation and act together as a unit.

In FIG. 14, upper hull tanks B are now deballasted and the apparatus is raised to a selected operating draft. The lower hull is substantially fully ballasted by filling tanks A in the side walls,space 82 is filled with sea water, and pressure contact occurs between the shoulders 50 and 52 since tanks B in the upper hull are substantially deballasted. In selected operating draft the center of buoyancy CB and center of gravity CG are located as approximately indicated in FIG. 14.

As shown in FIG. 16 the shoulders 50 and 52 may be further secured by a number of stud bolts 74 extending upwardly from shoulder 52 through holes 76 in shoulder 50 and nuts 78 threaded on the bolt. The securement nut and bolt assemblies further assist in the unitary action of the upper and lower hull means in operating mode and draft. As further shown in FIG. 16, a sealing gasket 80 may be provided between the shoulders 50, 52 for the purpose of utilizing the space 82 for storage of oil if so desired.

As shown in FIG. 15 support lines 62 are released from the lower pontoon portion 40, maintain their guide connection at 64 at the top of side walls of the lower hull, and may then be deployed for connection to sea floor anchors (not shown) in known manner.

Means for flooding and deflooding selected compartmented tanks such as tanks A and B of the lower and upper hulls may be in accordance with general shipboard and submarine ballast design practice. In FIGS. 19 and 20 a system utilizing compressed air is shown for the lower hull. The system for the upper hull may comprise well known shipboard ballasting means since the upper hull and deck are secured together and the control and air lines may be fixed.

In FIG. 20 an exemplary system of valves and piping for the lower hull tanks A is shown. The system for the lower hull may include a reel 86 mounted on the deck for a compressed air line 88 and vent to atmosphere line 89. Line 88 is provided with a compressed air valve 95 and is connected to a compressed air source (not shown). The vent to atmosphere line 89 is provided with valve 96 upstream from reel 86. Air injection/vent line 90 extends downwardly from reel 86 to the top of the side walls 46 and may be connected to an air manifold means 91 to serve selected ballast tanks A in the lower hull. Exiting manifold means 91 is illustrated one air/vent injection line 90' which is shown extending downwardly along the exterior of wall 46 and entering the top of a lower tank A. Other lines 90' are connected to other selected tanks A for selective operation thereof.

An umbilical valve control line means comprising hydraulic power and control lines 92 may be carried by a reel 94 on the deck and is connected to a valve control module 97 carried on the top of side walls 46 and which controls the operation of selected flood valves 99, and air injection/vent valves 98. From module 97 control lines 93, 93' connect with various air injection/vent valves 98 and flood valves 99 which control the ballasting and deballasting of selected tanks A.

It will thus be readily understood that that water can be made to enter tank A in a controlled manner by shutting compressed air valve 88, opening vent valve 96 to atmosphere, opening valve 98 on the lower hull, and opening flood valve 99 at the bottom of lower tank A. Conversely water can be expelled from tank A by shutting valve 96 and injecting compressed air into tank A through the air injection/vent line 90'. Tanks A can thus be selectively flooded or deflooded in any relative position of the upper and lower hulls during installation at a well site or removal therefrom.

The hose reels 86 and 94 on the main deck are paid in or out to accommodate relative movement of the upper and lower hulls as the vessel is ballasted from transit draft to operating draft and visa versa.

In the exemplary embodiment of the invention shown in FIGS. 17 and 18, lower hull means 100 may comprise a lower pontoon portion 102 similar in construction to lower pontoon portion 40. In place of the upstanding side walls 46 a plurality of compartmented columns 104 in spaced circular relation define a central body opening 106 within which upper hull means 108 is received and relatively vertically movable. The tops of columns 104 are connected by an annular top wall 110 providing an opening 112 through which the upper hull means 114 may vertically move.

Upper hull means 114 may be similar in construction as upper hull means 28 of the first example. A deck 116 is assembled with and carried by the upper hull means 114 similar to the prior embodiment of this invention.

Outboardly extending shoulders (not shown) at the bottom of the upper hull means 114 are arranged for engagement with the inboard margins of top wall 110 in a manner similar to shoulders 50, 52 of the prior embodiment. In operating mode,such shoulders and inboard margins of the top wall may be secured as in the prior embodiment. Guide means 116 are also provided on the exterior surfaces of the upper hull and inboard margins of the top wall 110 to limit relative rotation of the hull means as in the prior embodiment.

In operating mode, FIG. 18, the columns in circular spaced relation form lower hull vertical openings 118 extending from the top of pontoon portion 102 to the bottom surface of the top wall 110. Wave or sea currents may pass through said openings 118 and the response of the lower hull means and the apparatus in operating mode is different than that of the apparatus of the prior example of the invention.

Since the water plane area of the lower hull means 100 is different than lower hull 26, flooding of compartments in the columns is increased during installation of the apparatus in order to maintain necessary stability of the apparatus. It will be understood that support and anchor lines 120 are provided on the apparatus and are operated in a manner to that described in the prior example during transition of the upper and lower hull means from towing draft to operating draft.

It will be apparent to those skilled in the art that an offshore oil apparatus embodying the inventions described above provide many advantages over prior proposed offshore apparatus for use in deep water including:

1. Fabrication and construction of the apparatus in vertical mode, thus avoiding towing in horizontal position and moving to vertical position at a well site.
2. Transporting the apparatus in a stable vertical position.
3. A novel method of controllably relatively moving an upper hull means from telescoped assembly with a lower hull means to non-telescoped relation at a well site.
4. Securing and maintaining upper and lower hull means in extended non-telescoped relation for acting as a unit and having a bottom portion of the lower hull located in deep water and away from significant wave action in operating mode.
5. In the second example, providing transparency to wave currents by spaced columns in the lower hull construction in operating mode.

It will be understood that various modifications and changes may be made in,the above described embodiments of this invention and all such changes and modifications coming within the spirit of this invention and the scope of the claims appended hereto are embraced thereby.

I claim:

1. An apparatus for offshore operations, comprising in combination:

an upper hull and a deck carried thereby;

a lower hull having an upwardly facing body opening to receive said upper hull for relative vertical movement between closed telescopic relation and extended non-telescopic relation;

said lower hull including pontoon means to support said upper and lower hulls and said deck during transit and to provide sufficient water plane moment of inertia for stability during transit;

tension line means connecting said deck and said lower hull; guide means on said upper and lower hulls for said relative vertical movement;

stop means on said upper hull engageable with stop means on said lower hull for limiting extended relation of said upper and lower hulls;

and means for selectively ballasting said upper and lower hulls and said pontoon means for controlling relative positions of said hulls and of the centers of buoyancy and gravity of the apparatus during transit, installation, and operations.

2. An apparatus as stated in claim 1 wherein said body opening is defined by an upstanding skirt-like wall rising above said pontoon means and including ballast compartments.

3. An apparatus as claimed in claim 1 wherein said lower hull includes a plurality of upstanding circularly spaced columns having ballast compartments.

4. An apparatus as claimed in claim 2 wherein said skirt-like wall is flared adjacent said pontoon means to provide selected water plane areas during installation of the apparatus at a well site.

5. An apparatus as claimed in claim 1 including anchor means connecting said hulls to the sea floor.

6. An apparatus as claimed in claim 1 including means for positioning said apparatus.

7. An apparatus as claimed in claim 1 wherein seal means are provided between said stop means on said hulls whereby said body opening is adapted for storage of oil.

8. An apparatus as claimed in claim 1 wherein said lower hull includes a passageway through said pontoon for riser means and for access of sea water to said body opening to entrap sea water and enhance motion characteristics of said apparatus.

9. An apparatus as claimed in claim 1 wherein said body opening of the lower hull includes a recess in the pontoon means to receive the lower end of the upper hull.

10. An apparatus as claimed in claim 1 wherein said pontoon means extends laterally beyond said body opening to provide selected water plane area.

11. An apparatus for offshore oil operations, comprising in combination:

means for supporting and stabilizing said apparatus including pontoon means having selected displacement and having a water plane area whereby said apparatus may be towed at a selected draft;

means carried by said support means providing an upwardly facing body opening;

means receivable within said means providing said body opening in telescopic relation therewith for relative movement and a deck means carried by said receivable means;

means connecting said deck means and said pontoon means for assisting in control of said relative movement;

means for selectively ballasting said support means and said means received within said body opening;

and shoulder means on said support means and shoulder means on said means receivable within said opening for abutting engagement when said receivable means is raised upwardly of said opening to maintain said apparatus in operating mode.

12. An apparatus as claimed in claim 11 wherein said means carried by said support means includes means providing progressively diminishing water plane areas above the water plane area of the pontoon means.

13. An apparatus as claimed in claim 11 wherein said connecting means serves as anchor lines when the apparatus is in operating mode.

14. In a method of fabricating, transporting, installing, and operating a floating offshore apparatus for drilling, production, and storage of oil, the apparatus including telescopic arranged upper and lower hulls, said lower hull having a body opening in which the upper hull is received and includes a pontoon having a selected water plane area, said upper and lower hulls having selectively floodable variable ballast tanks, and a deck on top of the upper hull; the steps of:

fabricating the apparatus with the upper hull within the body opening of the lower hull and in telescopic relation;

supporting the upper and lower hulls in such relation during transport at towing draft;

flooding selected tanks to provide a slightly positively buoyant lower hull, providing sufficient water plane area above said pontoon to assure stability during towing;

flooding selected ballast tanks in the upper hull to lower the center of gravity of the upper hull in the body opening;

flooding selected tanks in the pontoon so that the buoyancy of the pontoon is slightly negative;

connecting the deck to the lower hull by support lines;

further flooding tanks in the pontoon while maintaining selected tension of the support lines until the lower hull is completely submerged;

continuing flooding of pontoon tanks and lower hull tanks until the upper hull is displaced upwardly in the body opening and is in non-telescopic relation to the lower hull;

holding the non-telescopic relation of the upper and lower hulls by abutting stop means thereon;

deballasting the upper hull to raise the upper and lower hulls to operating draft;

and holding the position of the apparatus relative to a well site.

15. In the method as claimed in claim 14 including the step of;

varying the water plane area of the lower hull during relative vertical movement of the upper and lower hulls.

16. In the method as claimed in claim 14 including the step of:

securing the stop means in abutting relation when the upper and lower hulls are in non-telescopic relation.

17. In the method as claimed in claim 14 including the step of:

sealing the body opening at the stop means.

* * * * *